US009684270B2

(12) United States Patent
Iida

(10) Patent No.: US 9,684,270 B2
(45) Date of Patent: Jun. 20, 2017

(54) FIXING APPARATUS HAVING STORAGE DEVICE FOR STORING CHARACTERISTICS OF FIXING MEMBER

(71) Applicant: CANON KABUSHIKI KAISHA, Tokyo (JP)

(72) Inventor: Masamichi Iida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/071,592

(22) Filed: Mar. 16, 2016

(65) Prior Publication Data

US 2016/0291522 A1 Oct. 6, 2016

(30) Foreign Application Priority Data

Mar. 31, 2015 (JP) ..... 2015-073215

(51) Int. Cl.
*G03G 15/20* (2006.01)
*G03G 15/00* (2006.01)
*G03G 21/16* (2006.01)

(52) U.S. Cl.
CPC ..... *G03G 15/2014* (2013.01); *G03G 15/2039* (2013.01); *G03G 15/55* (2013.01); *G03G 15/80* (2013.01); *G03G 21/1652* (2013.01); *G03G 21/1685* (2013.01); *G03G 2215/2035* (2013.01); *G03G 2221/1639* (2013.01)

(58) Field of Classification Search
CPC ..... G03G 15/2014; G03G 15/55; G03G 21/1652; G03G 21/1685; G03G 2221/1639
USPC ..... 399/12, 33; 219/216
See application file for complete search history.

(56) References Cited

U.S. PATENT DOCUMENTS 5,021,828 A * 6/1991 Yamaguchi ..... G03G 15/553 399/24
5,528,269 A * 6/1996 Drogo ..... B41J 2/195 347/19
5,663,902 A 9/1997 Bennett et al.
6,101,319 A * 8/2000 Hall ..... G06F 11/006 714/42
6,104,888 A * 8/2000 Kobayashi ..... G03G 21/1875 399/12
6,946,331 B2 9/2005 Kimino
7,473,319 B2 1/2009 Kimino
2002/0180820 A1 * 12/2002 Tsuruoka ..... B41J 2/17566 347/19
2004/0096591 A1 5/2004 Kimino
(Continued)

FOREIGN PATENT DOCUMENTS

JP 01227164 A * 9/1989
JP 03062051 A * 3/1991
(Continued)

*Primary Examiner* — Robert Beatty
(74) *Attorney, Agent, or Firm* — Fitzpatrick, Cella, Harper & Scinto

(57) ABSTRACT

A fixing apparatus fixes an image onto a recording material. A first fuse and a second fuse are connected in series each other. A power supply line is connected to one end of the first fuse. A signal line is connected to a connection point between another end of the first fuse and one end of the second fuse. A ground line is connected to another end of the second fuse. Information regarding the fixing apparatus is held in accordance with melt states of the first and second fuses.

20 Claims, 9 Drawing Sheets

(56) References Cited

U.S. PATENT DOCUMENTS

| | | | | |
|---|---|---|---|---|
| 2004/0179054 | A1* | 9/2004 | Li | B41J 2/17546 347/19 |
| 2005/0168511 | A1* | 8/2005 | Hu | B41J 2/17546 347/19 |
| 2005/0259123 | A1* | 11/2005 | Rice | B41J 2/14 347/5 |
| 2006/0030153 | A1 | 2/2006 | Kimino | |
| 2009/0108399 | A1 | 4/2009 | Kimino | |
| 2015/0023088 | A1* | 1/2015 | Sforzin | G11C 17/16 365/96 |
| 2015/0177681 | A1* | 6/2015 | Yamada | G03G 21/1652 399/12 |

FOREIGN PATENT DOCUMENTS

| | | | | |
|---|---|---|---|---|
| JP | 08078297 | A | * | 3/1996 |
| JP | 09218619 | A | * | 8/1997 |
| JP | 10-092290 | A | | 4/1998 |
| JP | 11-305579 | A | | 11/1999 |
| JP | 2004-111671 | A | | 8/2004 |
| JP | 2004-347744 | A | | 12/2004 |
| JP | 2005-302755 | A | | 10/2005 |

* cited by examiner

FIG. 9A

| FUSE 203 | FUSE 204 | FIXING APPARATUS STATE |
|---|---|---|
| SHORT | SHORT | — |
| OPEN | SHORT | STATE 1 |
| SHORT | OPEN | STATE 2 |
| OPEN | OPEN | STATE 3 |

FIG. 9B

| FUSE 203 | FUSE 204 | FIXING APPARATUS STATE | AD VALUE(typ) | AD VALUE THRESHOLD |
|---|---|---|---|---|
| SHORT | SHORT | — | — | — |
| OPEN | SHORT | STATE 1 | 0V | AD VALUE < 0.5V |
| SHORT | OPEN | STATE 2 | 1.65V | 2.8V < AD VALUE |
| OPEN | OPEN | STATE 3 | 3.3V | 0.5V ≤ AD VALUE ≤ 2.8V |

FIG. 9C

| FUSE 203 | FUSE 204 | FIXING APPARATUS STATE | AD VALUE(typ) |
|---|---|---|---|
| SHORT | SHORT | — | — |
| OPEN | SHORT | STATE 1 | 0V |
| SHORT | OPEN | STATE 2 | 1.48V |
| OPEN | OPEN | STATE 3 | 3.3V |

FIXING APPARATUS HAVING STORAGE DEVICE FOR STORING CHARACTERISTICS OF FIXING MEMBER

BACKGROUND OF THE INVENTION

Field of the Invention

The present invention relates to a fixing apparatus having a storage function.

Description of the Related Art

Components used in image forming apparatuses have individual differences, and there is thus demand for components to be controlled in accordance with such individual differences. A fixing apparatus is a representative example of such a component. A fixing apparatus has a fixing film and a pressure roller, and variations can arise in the glossiness of a fixed image due to variations in the characteristics of the fixing film and the pressure roller in the fixing apparatus. Thus a fixing temperature may be controlled in accordance with such variations in the glossiness. Japanese Patent Laid-Open No. 11-305579 proposes storing information regarding a fixing apparatus in a non-volatile memory provided in the fixing apparatus. Japanese Patent Laid-Open No. 2004-347744, meanwhile, proposes holding a gloss level of a fixing apparatus using a dip switch.

However, providing a non-volatile memory not only increases costs, but the content stored therein may change under the influence of outside noise or the like. Providing a dip switch also increases costs, and it is furthermore necessary for the person in charge of assembly at the factory to manipulate such small dip switches, which complicates the assembly process.

SUMMARY OF THE INVENTION

Accordingly, the present invention provides an information holding technique capable of holding information of components or the like of an image forming apparatus comparatively cheaply and stably, and capable of lightening the burden on a person in charge of assembly.

The present invention provides a fixing apparatus for fixing an image onto a recording material, comprising the following elements. A first fuse and a second fuse are connected in series each other. A power supply line is connected to one end of the first fuse. A signal line is connected to a connection point between another end of the first fuse and one end of the second fuse. A ground line is connected to another end of the second fuse. Information regarding the fixing apparatus is held in accordance with melt states of the first and second fuses.

Further features of the present invention will become apparent from the following description of exemplary embodiments (with reference to the attached drawings).

BRIEF DESCRIPTION OF THE DRAWINGS

FIGS. 9A to 9C are tables illustrating relationships between fuse states and stored information.

DESCRIPTION OF THE EMBODIMENTS

Figure 1:
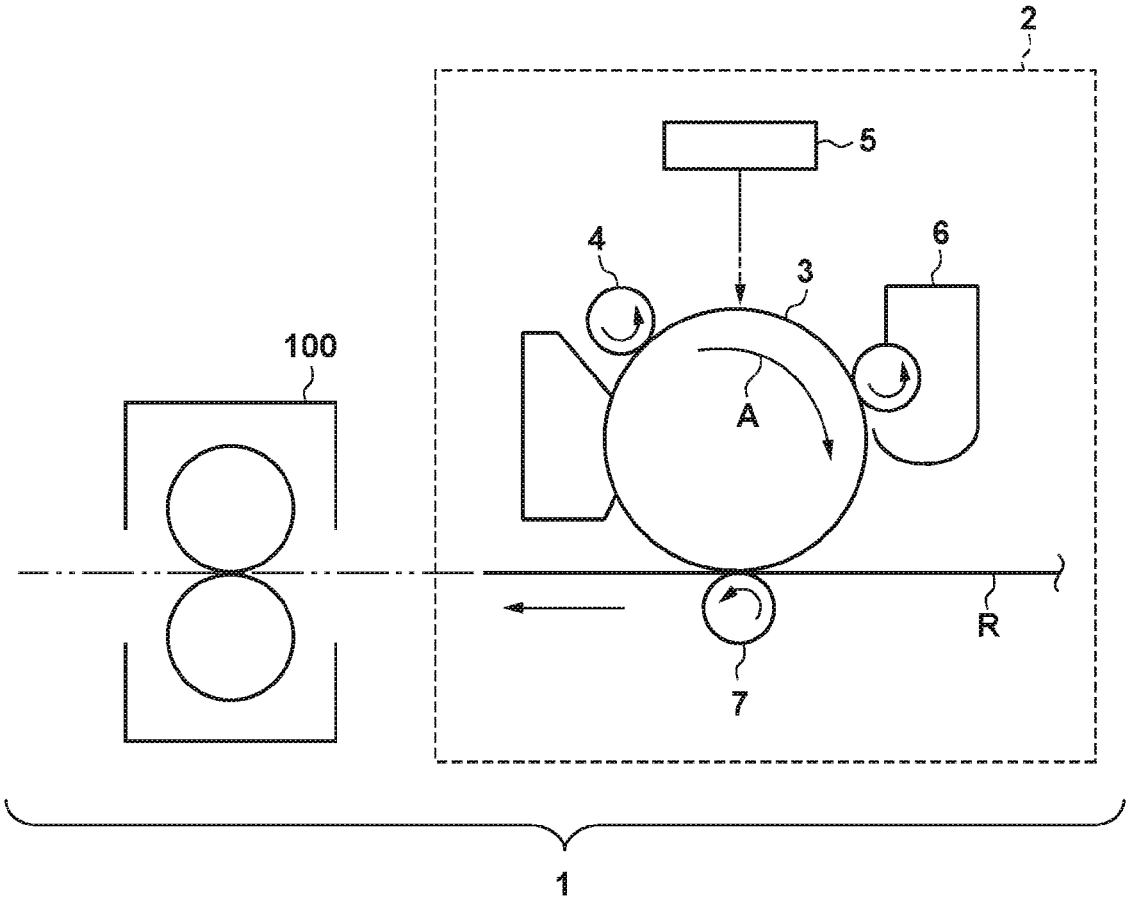
FIG. 1 is a schematic diagram illustrating an image forming apparatus.

An image forming apparatus 1 will be described using FIG. 1. The image forming apparatus 1 includes an image forming section 2 that forms a toner image on a recording material R and a fixing apparatus 100 that fixes the toner image onto the recording material R. Note that the recording material may be referred to as a recording medium, paper, a sheet, transfer material, transfer paper, or the like. The image forming section 2 includes a photosensitive drum 3, serving as an image carrier, that is rotationally driven in a direction of an arrow A. A charging unit 4, an exposure unit 5, and a developing unit 6 are disposed in the periphery of the photosensitive drum 3. The charging unit 4 is a charging unit that charges the circumferential surface of the photosensitive drum 3 to a uniform potential. The exposure unit 5 is an exposure unit that forms an electrostatic latent image on the circumferential surface of the photosensitive drum 3 by emitting a laser beam based on image data. The developing unit 6 is a developing unit that develops the electrostatic latent image by causing toner to adhere thereto, thus forming a toner image on the circumferential surface of the photosensitive drum 3. A transfer unit 7 is a transfer unit that transfers the toner image formed on the circumferential surface of the photosensitive drum 3 onto the recording material R. The fixing apparatus 100 is a fixing unit that fixes the toner image to the recording material R by heating and pressurizing the toner image.

Figure 2:
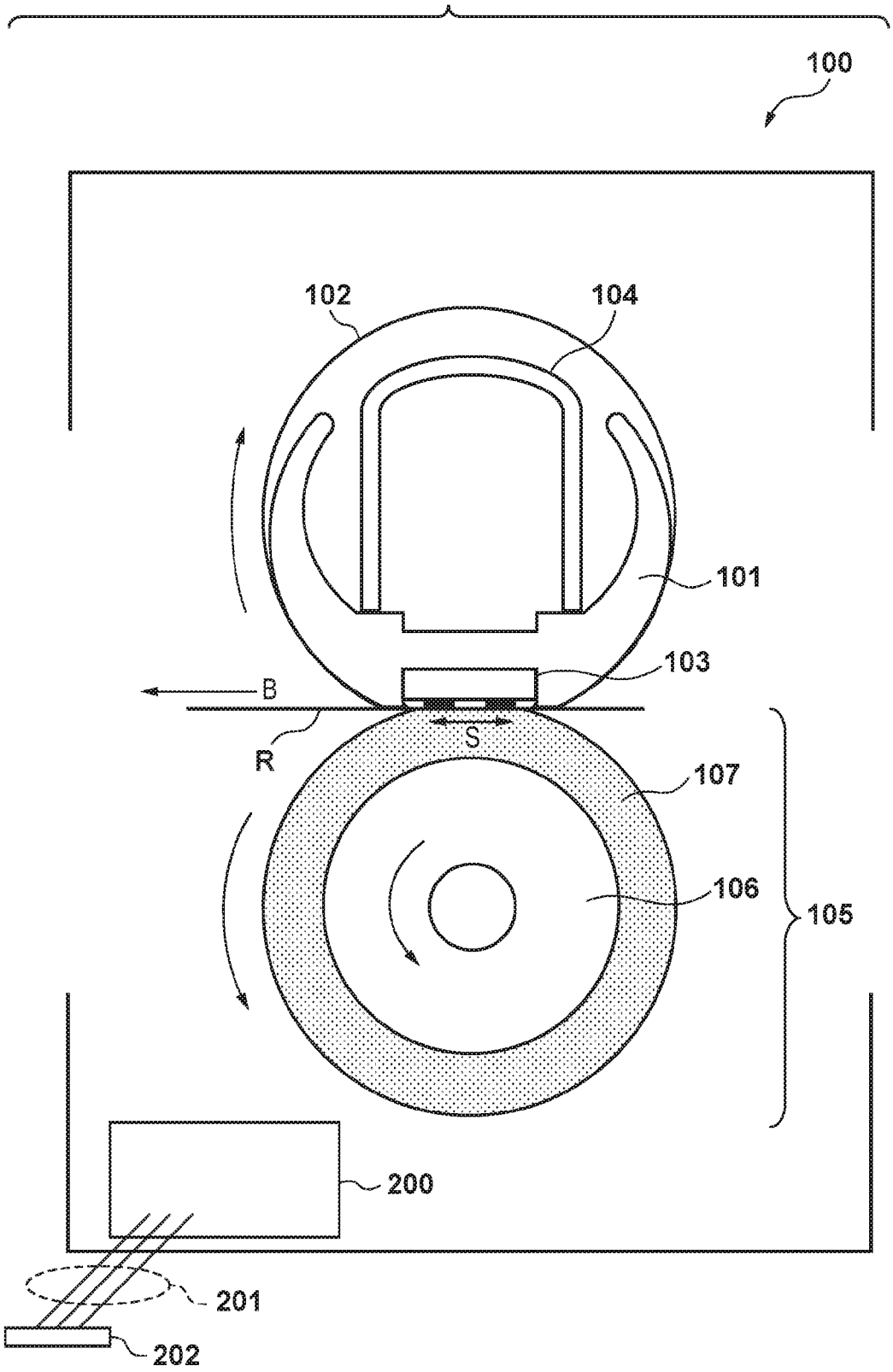
FIG. 2 is a schematic diagram illustrating a fixing apparatus.

An example of the fixing apparatus 100 will be described using FIG. 2. A fixing film 102 is a flexible film having a cylindrical shape. A heater 103 makes contact with an inner surface of the fixing film 102 and heats the fixing film 102. A pressure roller 105 makes contact with an outer surface of the fixing film 102 and rotates along with the fixing film 102. A fixing nip area S is formed at the location where the pressure roller 105 comes into contact with the fixing film 102. The heater 103 is held by a holding member 101, which is formed from a heat-resistant resin. The holding member 101 also has a guide function for guiding the rotation of the fixing film 102. A stay 104 is formed from a metal, and biases the holding member 101 for the pressure roller 105. A single-layer film, a composite film, or the like may be used as the fixing film 102. The pressure roller 105 is an elastic roller having a cored bar 106 formed from a material such as iron or aluminum, and an elastic layer 107 formed from a material such as silicone rubber. The fixing film 102 is pinched between the pressure roller 105 and the heater 103 and pressurized. The recording material R is transported in the direction of an arrow B, and the toner images fixed thereon when the recording material R traverses the fixing nip area S.

A memory board 200 is a storage device including a storage circuit that holds information regarding the fixing apparatus 100, and is supported by a housing of the fixing apparatus 100. The memory board 200 has three cables 201. A connector 202 is provided at an end portion of the three cables 201. The connector 202 is connected to a controller board. A receptacle that fits with the connector 202 may be provided in the controller board. Terminals connected to the end portions of the respective lines are provided in the connector 202, the receptacle, and so on. The respective terminals make contact and are connected with each other when the connector 202 and the receptacle are fitted together. The controller board includes a control device that controls the fixing apparatus 100, and is fixed to the interior of the image forming apparatus 1.

First Embodiment

Memory Board

The configuration of the memory board 200 will be described using FIG. 3. The memory board 200 includes a first fuse 203 and a second fuse 204. The second fuse 204 is connected in series to the first fuse 203. A power supply line 10 is connected to one end of the first fuse 203. A signal line 11 is connected to a connection point between the other end of the first fuse 203 and one end of the second fuse 204. The signal line 11 conveys an SNS1 signal from the memory board 200 to a controller board 300. A ground line 12 is connected to the other end of the second fuse 204. The power supply line 10 is connected by the connector 202 to a 3.3 V power supply of the controller board 300. The ground line 12 is connected by the connector 202 to a grounding point GND of the controller board 300. The ground line 12 is thus given a ground potential (a reference potential).

The memory board 200 holds three states (information) by at least one of the first fuse 203 and the second fuse 204 being melted during the process of manufacturing the fixing apparatus 100, which will be described later. In other words, three pieces of information are held based on the melt state of the two fuses. FIG. 9A illustrates a correspondence relationship between a set of the state of the first fuse 203 and the state of the second fuse 204, and a state of the fixing apparatus 100. In FIG. 9A, "short" indicates that the fuse is not melted. This may also be referred to as being "shorted". "Open" indicates that the fuse is melted. State 1 indicates that the characteristics of the fixing apparatus 100 are first characteristics. State 2 indicates that the characteristics of the fixing apparatus 100 are second characteristics. State 3 indicates that the characteristics of the fixing apparatus 100 are third characteristics. The memory board 200 holds information regarding the characteristics of the fixing apparatus 100 in this manner.

Figure 3:
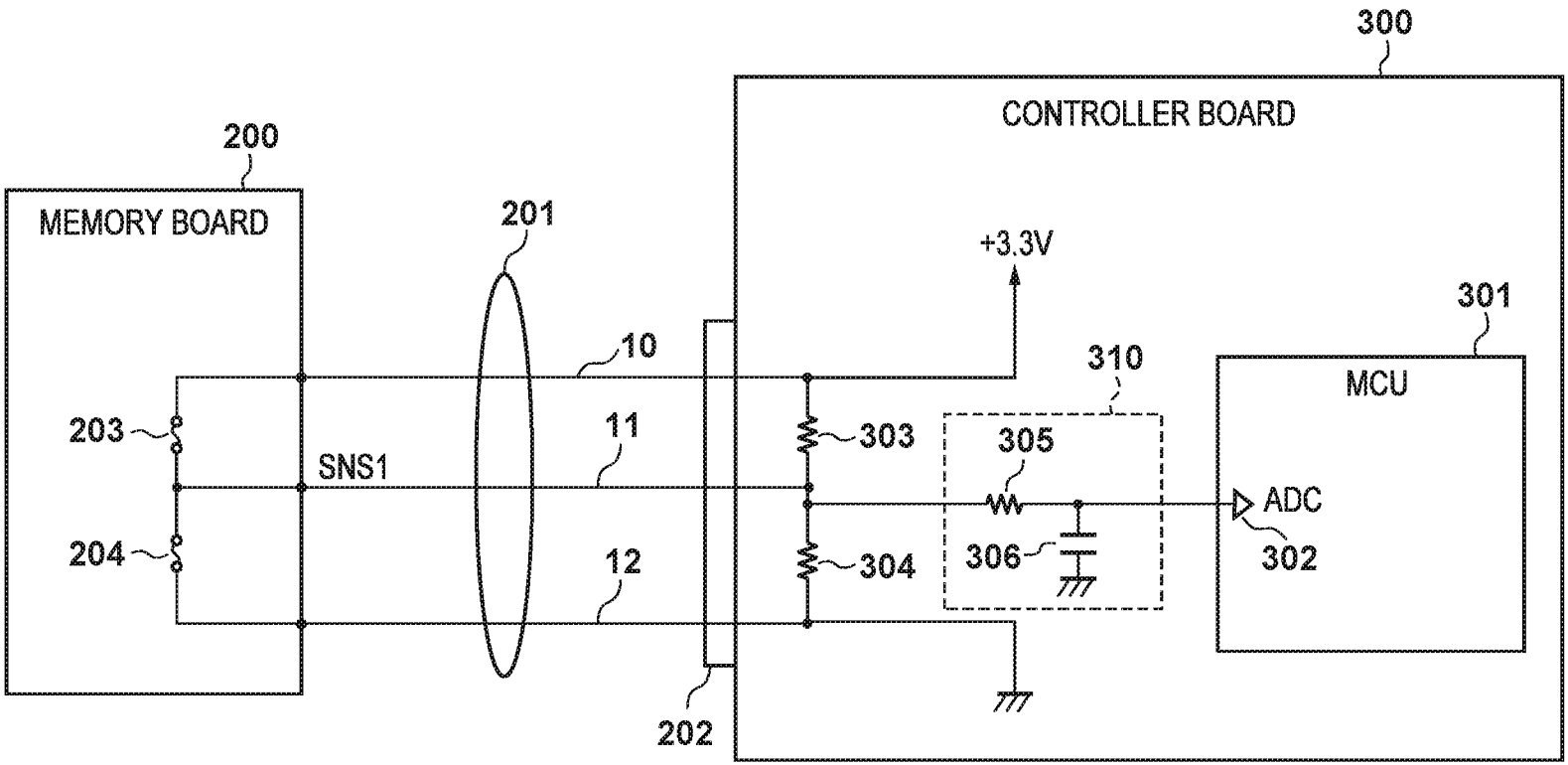
FIG. 3 is a diagram illustrating a memory board and a controller board.

As is clear from the circuit diagram given in FIG. 3, the 3.3 V power supply line 10 and the ground line 12 are shorted in the case where neither the first fuse 203 nor the second fuse 204 are melted. Accordingly, the apparatus is shipped from the factory with at least one of the first fuse 203 and the second fuse 204 melted.

Controller Board

As illustrated in FIG. 3, the controller board 300 is a control device that controls the fixing apparatus 100. A microcontroller (MCU, hereinafter) 301 functions as a control circuit. The MCU 301 includes an AD converter 302. The AD converter 302 converts an analog signal input to an input into a digital signal. The logic of the SNS1 signal output from the memory board 200 to the controller board 300 through the signal line 11 is established by a resistor 303, which is a pull-up resistor, and a resistor 304, which is a pull-down resistor. For example, a resistance value of 10 [kΩ] is selected for the resistor 303 and a resistance value of 10 [kΩ] is selected for the resistor 304.

The logic of the SNS1 signal can have error if outside noise or the like is superimposed on the SNS1 signal. Accordingly, a noise filter 310 may be added to reduce outside noise. The noise filter 310 may be a low-pass filter constituted by a resistor 305 and a capacitor 306. The resistance value of the resistor 305 and the capacitance of the capacitor 306 are determined in accordance with the frequency of the noise to be reduced. By adding the noise filter 310 in this manner, the MCU 301 can more stably detect the characteristics of the fixing apparatus 100 set in the process for manufacturing the fixing apparatus 100.

In this manner, the memory board 200 holds three states of the fixing apparatus 100, which are achieved through combinations of open/shorted for the first fuse 203 and open/shorted for the second fuse 204. The information held in the memory board 200 is, for example, information specifying a heater resistance value of the heater 103, glossiness of the fixing film 102 or the pressure roller 105, or the like. The MCU 301 obtains the characteristic information from the memory board 200, selects a control algorithm based on the characteristic information, and controls the fixing temperature of the fixing apparatus 100.

Jig Tool

A jig tool 400 will be described using FIG. 4. The jig tool 400 is connected to the memory board 200 during the process for manufacturing the fixing apparatus 100, and writes information regarding the characteristics of the fixing apparatus 100. The writing of this information is achieved by melting at least one of the first fuse 203 and the second fuse 204.

In the manufacturing process, the memory board 200 is connected to the jig tool 400 by the cables 201 and the connector 202. The jig tool 400 includes a melting circuit 420 and a verification circuit 430. The melting circuit 420 has a constant current source 414 that generates a melting current for melting the first fuse 203 and the second fuse 204 provided in the memory board 200. Furthermore, the melting circuit 420 has an overvoltage reduction resistor 413 that reduces overvoltage from being applied to the first fuse 203 and the second fuse 204 in the case where those fuses are melted. This resistor 413 is connected between one end and the other end of the constant current source 414. The melting circuit 420 has three relays 410, 411, and 412 that are controlled on/off by an MCU 401. Note that a relay is a type of switch, and any element capable of being controlled on/off by the MCU 401 can be employed instead of a relay. The first relay 410 is a first switch that connects and disconnects the power supply line 10 and one end of the constant current source 414. The second relay 411 is a second switch that connects and disconnects the signal line 11 and the other end of the constant current source 414. The third relay 412 is a third switch that connects and disconnects the ground line 12 and the one end of the constant current source 414. The MCU 401 controls the relays 410, 411, and 412 on/off in accordance with the information to be held by the memory board 200.

The verification circuit 430 is a circuit that, after one of the fuses has been melted, verifies that the intended fuse has been melted. The verification circuit 430 includes the MCU 401. Note that the functions of resistors 403, 404, and 405, a capacitor 406, and an AD converter 402 are the same as the functions of the resistors 303, 304, and 305, the capacitor 306, and the AD converter 302 described with reference to FIG. 3. The connection relationships of the power supply line 10, the signal line 11, and the ground line 12 with respect to these circuit elements are also the same as those described earlier. As such, detailed descriptions of these functions will be omitted.

Figure 4:
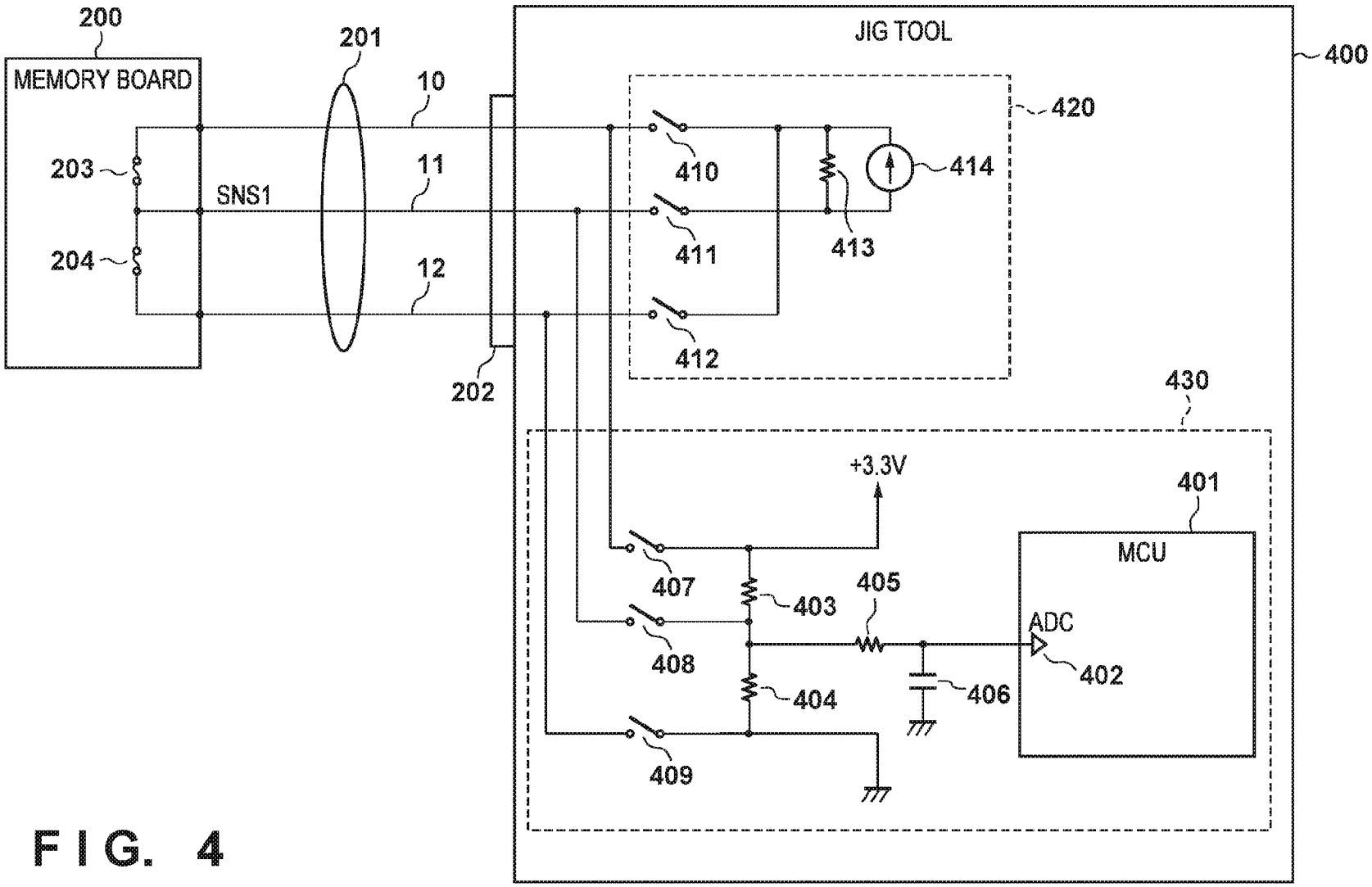
FIG. 4 is a diagram illustrating a memory board and a jig tool.

As illustrated in FIG. 4, the jig tool 400 is provided with a fourth relay 407, a fifth relay 408, and a sixth relay 409 that are controlled on/off by the MCU 401 in order to separate the storage process (a fuse melting process) from a storage verification process (a melt verification process). Upon transiting to the fuse melting process, the MCU 401 switches all of the relays 407, 408, and 409 off. On the other hand, upon transiting to the melt verification process, the MCU 401 switches all of the relays 407, 408, and 409 on.

Storage Process and Storage Verification Process

The storage process and the storage verification process will be described using the flowchart illustrated in FIG. 5. In S1, the MCU 401 makes initial settings. "Initial settings" is a preparation process necessary for the jig tool 400 to execute the storage process. As the initial settings, the MCU 401 turns the 3.3 V power supply off. This is because when the terminals that are to be connected to the connector 202 are energized, a large current will flow in the memory board 200, the jig tool 400, and so on if the connector 202 is connected to those terminals. When the MCU 401 turns the 3.3 V power supply off, a message prompting an operator to connect the connector 202 to the jig tool 400 is displayed in a display unit. The operator connects the connector 202 of the memory board 200 to the jig tool 400 in response to the message. Upon successfully connecting the connector 202, the operator makes an operation indicating the connection is complete using an operating unit. Upon recognizing that the connection is complete, the MCU 401 turns the 3.3 V power supply on. The MCU 401 sets a current value of the constant current source 414 to 0 [A]. This is done to suppress an inrush current from flowing in the case where the relays 410, 411, and 412 are turned on. 0 [A] is merely an example, and any current value is sufficient as long as it is capable of suppressing an inrush current. The MCU 401 then turns all of the relays 407, 408, 409, 410, 411, and 412 off. This is done to protect the relays from being unintentionally turned on.

In S2, the MCU 401 obtains the information to be stored in the memory board 200. This information is obtained in the case where the memory board 200 is to hold information related to the fixing apparatus. For example, the MCU 401 obtains identification information (example: a serial number) by controlling a reading device to read a barcode affixed to the fixing apparatus 100. It is assumed that a state of the fixing apparatus 100 (a gloss level, the heater resistance value, and so on) is measured in advance during the manufacturing process, and is registered in a database on a network in association with the identification information. The MCU 401 obtains, from the database, information to be stored that corresponds to the obtained identification information. Information indicating the state of the fixing apparatus is obtained as a result. In this manner, the jig tool 400 may have a reading device and a network communication device.

Figure 6:
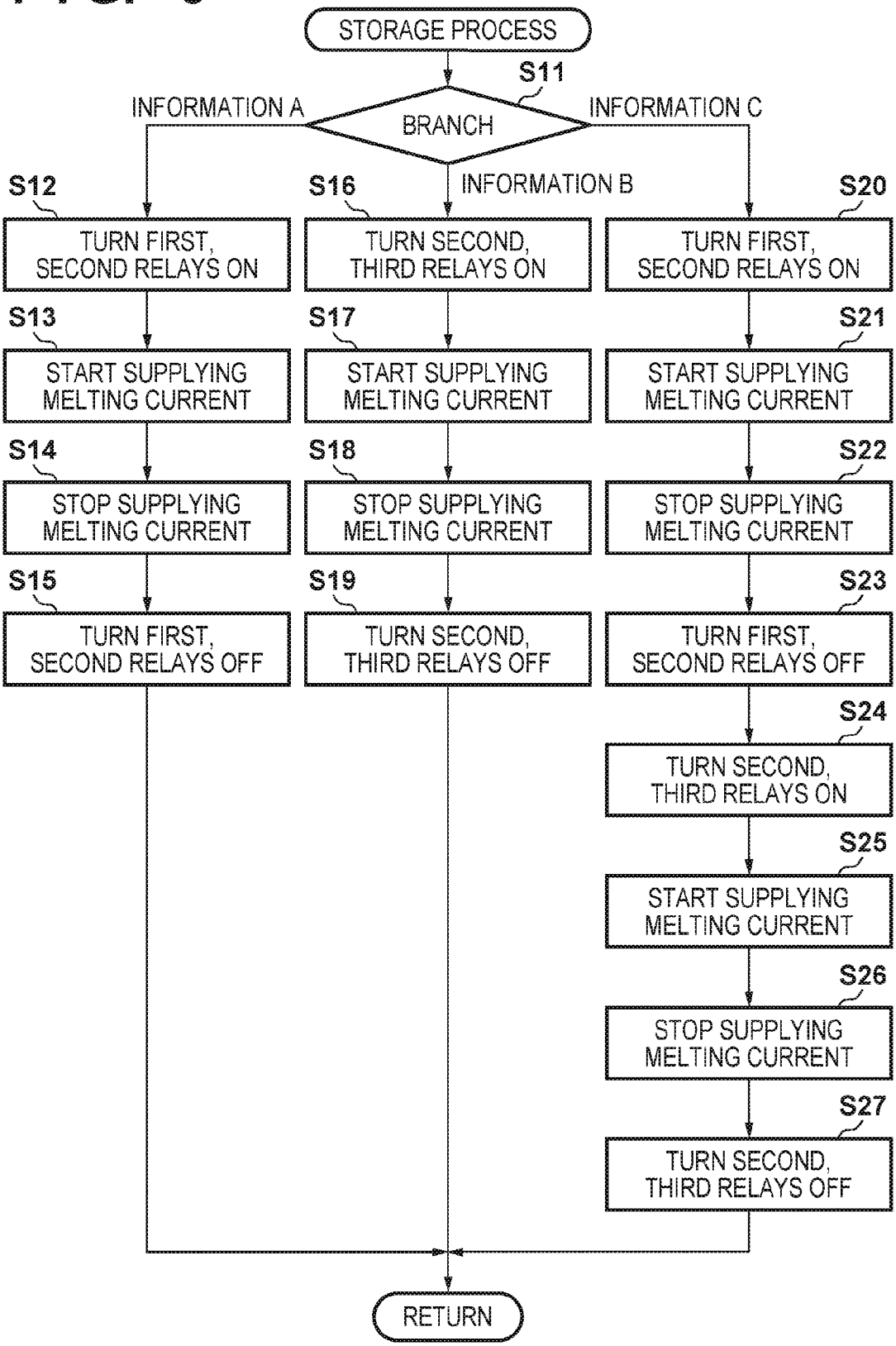
FIG. 6 is a flowchart illustrating the storage process in detail.

In S3, the MCU 401 stores the obtained information in the memory board 200. FIG. 6 illustrates an example of the storage process in detail. In S11, the MCU 401 determines whether the obtained information is information A, B, or C, and executes the storage process in accordance with the result of the determination. The information A, B, and C correspond to states 1, 2, and 3 of the fixing apparatus, respectively. The MCU 401 moves to S12 in the case where the obtained information is the information A. The information A is information held when the first fuse 203 is melted but the second fuse 204 is not melted.

In S12, the MCU 401 turns the first relay 410 and the second relay 411 on in order to melt the first fuse 203. In S13, the MCU 401 controls the constant current source 414 to start supplying the melting current to the first fuse 203. For example, the MCU 401 increases the current of the constant current source 414 to a current capable of melting the first fuse 203. In S14, the MCU 401 controls the constant current source 414 to stop supplying the melting current. The first fuse 203 is melted by the melting current being supplied thereto over a predetermined amount of time. Accordingly, using a time measurement unit such as a timer, the MCU 401 measures the amount of time elapsed from when the current starts being supplied, and then sets the current value of the constant current source 414 to 0 [A] once the elapsed time reaches the predetermined amount of time. The melting current is stopped from being supplied as a result. In S15, the MCU 401 switches the first relay 410 and the second relay 411 off. The first fuse 203 is melted through this process. The process then returns to S4 of the main flowchart.

On the other hand, the MCU 401 moves to S16 when it is determined in S11 that the obtained information is the information B. The information B is information held when the first fuse 203 is not melted but the second fuse 204 is melted. In S16, the MCU 401 turns the second relay 411 and the third relay 412 on in order to melt the second fuse 204. In S17, the MCU 401 controls the constant current source 414 to start supplying the melting current to the second fuse 204. For example, the MCU 401 increases the current of the constant current source 414 to a current capable of melting the second fuse 204. In S18, the MCU 401 controls the constant current source 414 to stop supplying the melting current. The second fuse 204 is melted by the melting current being supplied thereto over a predetermined amount of time. Accordingly, using a time measurement unit such as a timer, the MCU 401 measures the amount of time elapsed from when the current starts being supplied, and then sets the current value of the constant current source 414 to 0 [A] once the elapsed time reaches the predetermined amount of time. The melting current is stopped from being supplied as a result. In S19, the MCU 401 switches the second relay 411 and the third relay 412 off. The second fuse 204 is melted through this process. The process then returns to S4 of the main flowchart.

Furthermore, the MCU 401 moves to S20 when it is determined in S11 that the obtained information is the information C. The information C is information held when both the first fuse 203 and the second fuse 204 are melted. In S20, the MCU 401 turns the first relay 410 and the second relay 411 on in order to melt the first fuse 203. In S21, the MCU 401 controls the constant current source 414 to start supplying the melting current to the first fuse 203. In S22, the MCU 401 controls the constant current source 414 to stop supplying the melting current. In S23, the MCU 401 switches the first relay 410 and the second relay 411 off. The first fuse 203 is melted through this process. Next, in S24, the MCU 401 turns the second relay 411 and the third relay 412 on in order to melt the second fuse 204. In S25, the MCU 401 controls the constant current source 414 to start supplying the melting current to the second fuse 204. In S26, the MCU 401 controls the constant current source 414 to stop supplying the melting current. In S27, the MCU 401 switches the second relay 411 and the third relay 412 off. The second fuse 204 is melted through this process. The process then returns to S4 of the main flowchart.

In S4, the MCU 401 verifies whether or not the information has been correctly stored in the memory board 200. Here, it is necessary to connect the memory board 200 to the verification circuit 430. The MCU 401 switches the fourth relay 407, the fifth relay 408, and the sixth relay 409 on. Next, the MCU 401 obtains the level of the SNS1 signal from the AD converter 402, and determines whether or not the stored information and the stated level correspond. FIG. 9B is a diagram indicating relationships between the state of the first fuse 203, the state of the second fuse 204, the state of the fixing apparatus (the information A, B, or C), and a level (AD value) and threshold of the SNS1 signal. These relationships are assumed to be stored in the aforementioned database or a storage device provided in the MCU 401 in advance. As indicated in FIG. 9B, the AD value output by the AD converter 402 is less than 0.5 V in the case where the fixing apparatus 100 is in state 1 (the information A). The AD value is greater than 2.8 V in the case where the fixing apparatus 100 is in state 2 (the information B). The AD value is greater than or equal to 0.5 V and less than or equal to 2.8 V in the case where the fixing apparatus 100 is in state 3 (the information C). In other words, the MCU 401 can determine which information is stored in the memory board 200 by comparing two thresholds with the level (AD value) of the SNS1 signal. When the information stored in the memory board 200 in S3 and the information read out from the memory board 200 match, the MCU 401 determines the storage to be a success, and displays a message indicating the success in the display unit. On the other hand, when the information stored in the memory board 200 in S3 and the information read out from the memory board 200 do not match, the MCU 401 determines the storage to be a failure, and displays a message indicating the failure in the display unit. In this manner, the jig tool 400 may include a display unit.

In S5, the MCU 401 executes an ending process. For example, the MCU 401 switches the fourth relay 407, the fifth relay 408, and the sixth relay 409 off. The MCU 401 then switches the 3.3 V power supply of the jig tool 400 off. Furthermore, the MCU 401 displays, in the display unit, a message prompting the operator to remove the connector 202 from the jig tool 400. The operator removes the memory board 200 from the jig tool 400 in response.

By executing the sequence described above, fuses, which are inexpensive, can be used as a medium to record data regarding the fixing apparatus 100, rather than using a non-volatile memory, dip switches, or the like. Furthermore, when recording the data regarding the fixing apparatus 100, the fuse melting process can be automated on the basis of a program, which simplifies the process of assembling the fixing apparatus 100.

Second Embodiment

A second embodiment will describe an example in which a fixing board is realized by providing the memory board 200 with a sensor (a detecting unit) that detects the recording material R. In the second embodiment, items that are the same as in the first embodiment will be given the same reference numerals, and descriptions thereof will be simplified thereby.

The configuration of a fixing board 500 will be described using FIG. 7. Like the memory board 200, the fixing board 500 includes the first fuse 203, the second fuse 204, and so on. The fixing board 500 further includes a photointerrupter 505, serving as a sensor that detects whether or not the recording material R is present. By the photointerrupter 505 detecting the recording material R discharged from the fixing apparatus 100, the MCU 301 detects recording material R jams in the vicinity of the fixing apparatus 100. The photointerrupter 505 includes an LED (light-emitting diode) serving as a light emitting element and a phototransistor serving as a light receiving element. The phototransistor may be a photodiode. An anode of the light-emitting diode is connected to the one end of the first fuse 203 and to the power supply line 10. A cathode of the light-emitting diode is connected to the other end of the second fuse 204 and to the ground line 12. A collector of the phototransistor is connected to a signal line 13 for conveying an SNS2 signal indicating whether or not the recording material R is present. An emitter of the phototransistor is connected to the cathode of the diode, the other end of the second fuse 204, and the ground line 12. A current limiting resistor 504 may be provided in order to limit the current that drives the light-emitting diode of the photointerrupter 505. The resistance value thereof is 330Ω, for example. A cable 501 includes the signal line 13 in addition to the power supply line 10, the signal line 11, and the ground line 12, and is connected to a controller board 506 by a connector 502.

The configuration of the controller board 506 is almost identical to that of the controller board 300. Accordingly, the descriptions will focus on the differences. The signal line 13 for conveying the SNS2 signal is connected to an IO port of the MCU 301 and one end of a load resistor 503. The other end of the load resistor 503 is connected to the 3.3 V power supply. The load resistor 503 is a load resistor for the phototransistor of the photointerrupter 505, and is provided in order to establish the logic of the SNS2 signal.

In this manner, the fixing board 500 has a memory function for storing information regarding the fixing apparatus 100, and the photointerrupter 505 that detects the recording material R discharged from the fixing apparatus 100. Here, the same 3.3 V power supply can be used as the 3.3 V power supply connected to the first fuse 203 and the 3.3 V power supply connected to the current limiting resistor 504. Only four signal lines need be used in the cable 501 that connects the fixing board 500 and the controller board 506. In other words, the power supply line 10 and the ground line 12 are shared between the portions corresponding to the memory board 200 and the photointerrupter 505, which makes it possible to reduce the number of signal lines.

Third Embodiment

Figure 7:
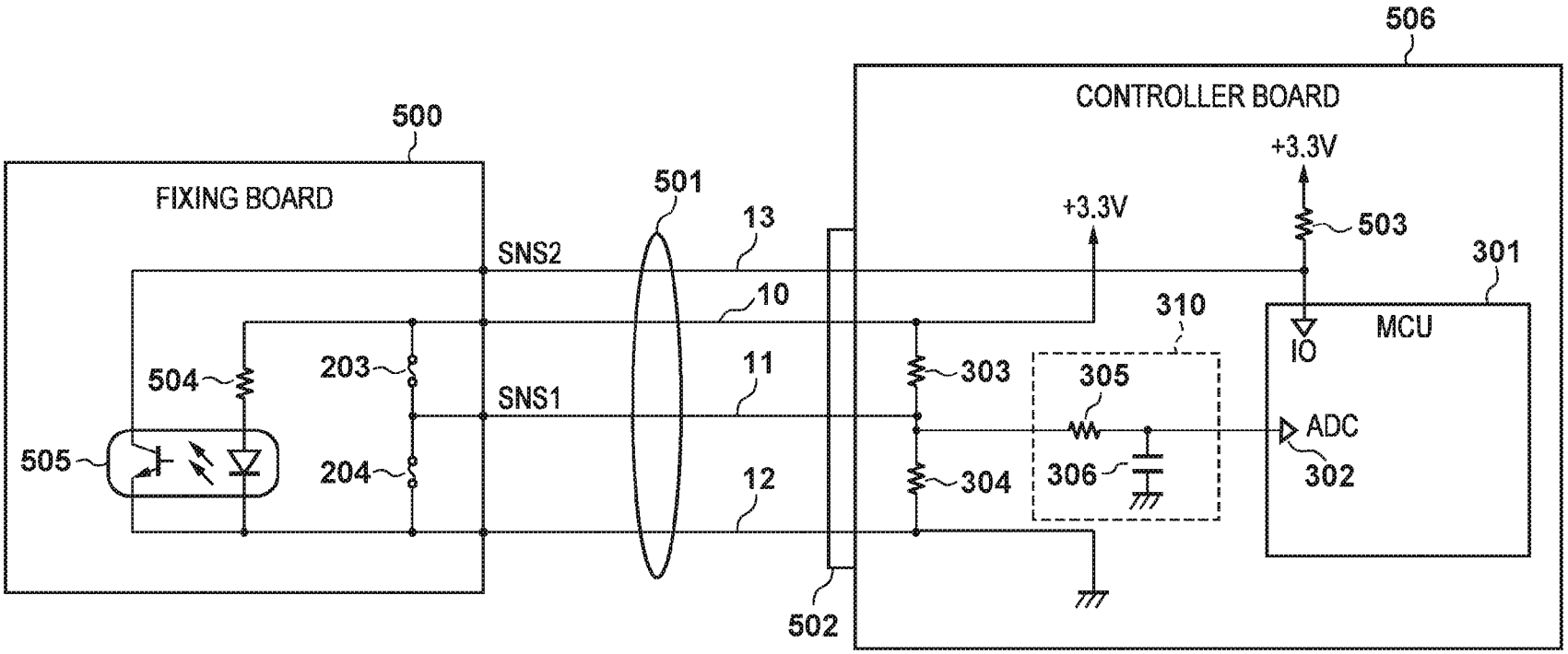
FIG. 7 is a diagram illustrating a fixing board and a controller board.

According to the configuration of the second embodiment described using FIG. 7, skipping the fuse melting process will result in the power supply line 10 and the ground line 12 shorting through the first fuse 203 and the second fuse 204. In other words, the power supply line from the 3.3 V power supply and the ground will short if the fixing board 500 and the controller board 506 are connected by the cable 501. Accordingly, the present embodiment proposes a circuit configuration in which the 3.3 V power supply line 10 and the ground line 12 will not short even if the fuse melting process is skipped. Furthermore, a configuration in which the MCU 301 can detect that the fuse melting process has been skipped will be described. Note that items that are the same as those already described will be given the same reference numerals, and descriptions thereof will be simplified thereby.

The configuration of a fixing board 600 will be described using FIG. 8. Like the fixing board 500, the fixing board 600 includes the photointerrupter 505, the first fuse 203, and the second fuse 204. A current limiting resistor 602 is connected to the photointerrupter 505. Furthermore, a current limiting resistor 601 that limits the current in the light-emitting diode of the photointerrupter 505 is provided in a controller board 603 as well. In other words, the above-described current limiting resistor 504 for the light-emitting diode is provided as two current limiting resistors 601 and 602. For example, the resistance value of the current limiting resistor 602 is 68 [Ω], and the resistance value of the current limiting resistor 601 is 261Ω. Here, the current limiting resistor 601 is disposed between the 3.3 V power supply and one end of the first fuse 203, and thus the resistance value between the 3.3 V power supply and the ground does not reach zero. In other words, the 3.3 V power supply and the ground will not short even if the fuse melting process is skipped.

In the case where neither the first fuse 203 nor the second fuse 204 are melted, the current from the power supply line 10 will pass through the first fuse 203 and the second fuse 204, and will not flow to the light-emitting diode of the photointerrupter 505. In other words, the light-emitting diode does not emit light, and thus the voltage level of the SNS2 signal, which is the output of the phototransistor, stays at 3.3 V regardless of whether or not the recording material R is present. In the process of assembling the image forming apparatus 1, a test print is generally executed at the factory when the assembly of the image forming apparatus 1 is complete. Because the fixing board 600 cannot detect whether or not the recording material R is present even if printing is executed, the MCU 301 determines that an error has occurred and ends the printing operations. This error indicates that the fuse melting process has been skipped.

FIG. 9C indicates representative AD values indicating the state of the fixing apparatus 100. As indicated in FIG. 9C, the first fuse 203 is open and the second fuse 204 is shorted in the case where the fixing apparatus 100 is in state 1. Accordingly, the input of the AD converter 302 is grounded by the second fuse 204, and thus the voltage level of the SNS1 signal is 0 V. Both ends of the first fuse 203 are shorted and the second fuse 204 is open in the case where the fixing apparatus 100 is in state 2. Here, assuming a forward voltage VF of the light-emitting diode of the photointerrupter 505 is 1 V, the voltage level of the SNS1 signal is 1.48 V. Both the first fuse 203 and the second fuse 204 are open in the case where the fixing apparatus 100 is in state 3. Accordingly, a voltage of 3.3 V is applied to the input of the AD converter 302 through the resistor 303, and thus the AD value is 3.3 V. In this manner, the three states (in other words, the three types of information) can be held using the circuit configuration illustrated in FIG. 8 as well.

CONCLUSION

Figure 8:
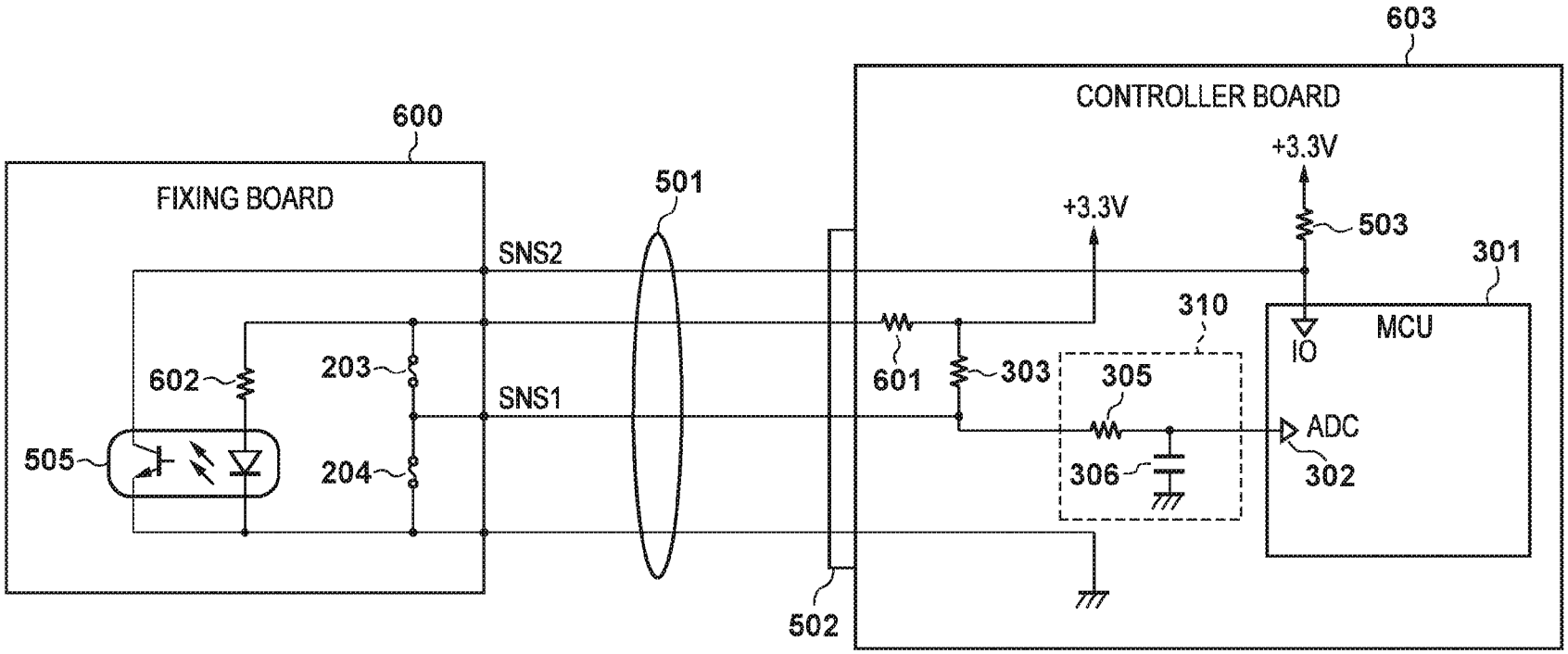
FIG. 8 is a diagram illustrating a fixing board and a controller board.

As described using FIGS. 3, 7, and 8, the memory board 200 and the fixing boards 500 and 600 function as storage devices. The storage device is mainly constituted by the first fuse 203 and the second fuse 204 that is connected in series to the first fuse 203. The power supply line 10 is connected to one end of the first fuse 203, and the signal line 11 is connected to the connection point between the other end of the first fuse 203 and one end of the second fuse 204. The ground line 12 is connected to the other end of the second fuse 204. Here, as described using FIGS. 9A to 9C, the storage device holds information in accordance with whether or not the first fuse 203 is melted and whether or not the second fuse 204 is melted. In this manner, according to the embodiments, the information can be held using the first fuse 203 and the second fuse 204, which makes it possible to provide a storage device that is less expensive than a non-volatile memory, dip switches, or the like. Furthermore, the storage device that uses the first fuse 203 and the second fuse 204 can hold the information in a more stable manner than a non-volatile memory. Further still, the storage device that uses the first fuse 203 and the second fuse 204 can reduce the burden on a person in charge of assembly more than in the case where dip switches are used.

As described using FIGS. 9A to 9C, first information (information A; state 1) is held when the first fuse 203 is melted but the second fuse 204 is not melted. Second information (information B; state 2) is held when the first fuse 203 is not melted but the second fuse 204 is melted. Third information (information C; state 3) is held when both the first fuse 203 and the second fuse 204 are melted.

Figure 5:
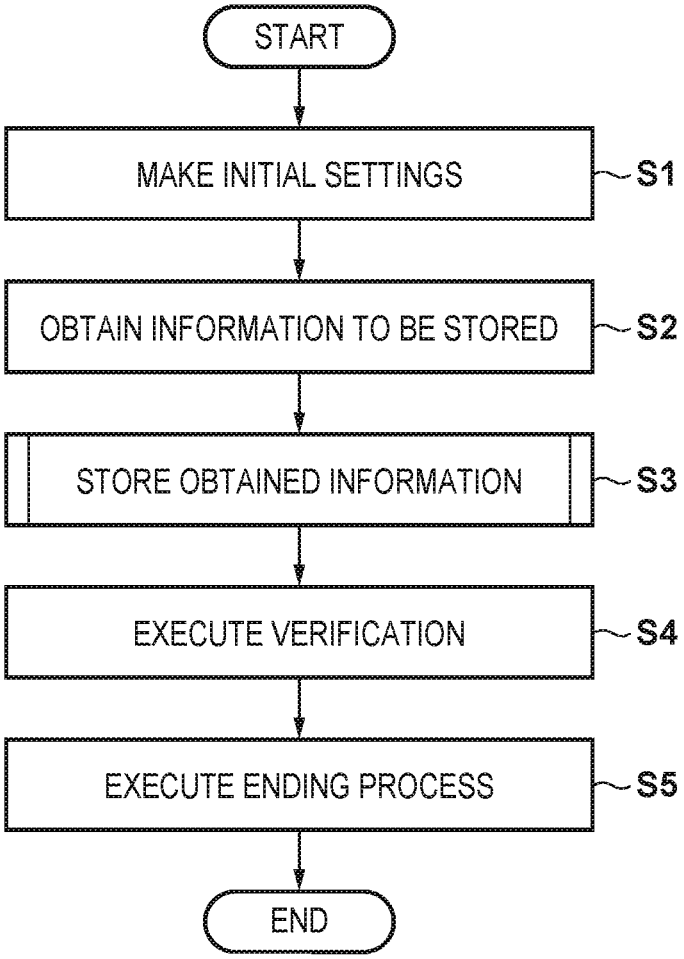
FIG. 5 is a flowchart illustrating a main sequence including a storage process and a verification process.

As described using FIGS. 5, 6, and so on, at least one of the first fuse 203 and the second fuse 204 is melted at the time of shipment from the factory. This makes it possible to store the information easily and in a stable manner.

As described using FIGS. 3, 7, and 8, the cables 201 and 501 may have the connectors 202 and 502 that include a terminal connected to the power supply line 10, a terminal connected to the signal line 11, and a terminal connected to the ground line 12.

As described using FIGS. 7, 8, and so on, the photointerrupter 505 is an example of a circuit element that differs from the first fuse 203 and the second fuse 204. A power supply voltage is applied to both the first fuse 203 and the photointerrupter 505 through the power supply line 10. In other words, the power supply line 10 can be shared by the fuse and the circuit element, which makes it possible to reduce the number of power supply lines and furthermore reduce the number of terminals in the connectors.

As described using FIGS. 7, 8, and so on, the memory board 200 may be mounted on the fixing boards 500 and 600 as a storage device mounted on a component of the image forming apparatus 1. Accordingly, information indicating the characteristics of the component can be held. The fixing apparatus 100 is an example of the component of the image forming apparatus 1. The memory board 200 may hold information indicating the characteristics of the fixing apparatus 100. Through this, information indicating the characteristics of the fixing apparatus 100 can be held inexpensively and in a stable manner. The information indicating the characteristics of the fixing apparatus 100 may be information regarding the glossiness of the fixing apparatus 100, information regarding the fixing temperature of the fixing apparatus 100 (such as a heater resistance value), or the like, for example. Through this, the controller boards 506 and 603 can execute control in accordance with the characteristics of the fixing apparatus 100 on the basis of the information read out from the fixing boards 500 and 600 included in the memory board 200.

The controller boards 300, 506, and 603 are examples of a control device connected to the storage device. The control device may have a first resistor connected in parallel to the first fuse 203 through the power supply line 10 and the signal line 11 (the resistor 303) and a second resistor connected in parallel to the second fuse 204 through the signal line 11 and the ground line 12 (the resistor 304). The MCU 301 functions as a determination circuit that is connected to the signal line 11 and determines the information held by the storage device in accordance with a voltage at the signal line 11. Note that the noise filter 310 may be provided between the signal line 11 and the input of the MCU 301. Doing so makes it possible to more accurately determine the information.

As described using FIG. 8, a shorting protection unit that protects the power supply line 10 and the ground line 12 from shorting when neither the first fuse 203 nor the second fuse 204 are melted may be provided. The shorting protection unit can be realized by the current limiting resistor 601 inserted in the power supply line 10, for example. The power supply line 10 and the ground line 12 are therefore protected from shorting by an inexpensive resistor. As described above, the MCU 301 and the photointerrupter 505 may function as a detecting unit that detects when neither the first fuse 203 nor the second fuse 204 are melted. This makes it possible to easily detect that the melting process has been skipped. Note that the detecting unit may be realized by the MCU 401 of the jig tool 400. In this case, the circuit configuration of the verification circuit 430 is the same as the circuit configuration of the controller board 603 illustrated in FIG. 8.

As described using FIG. 8, the storage device includes another signal line 13 that is different from the signal line 11, and a circuit that supplies an operating voltage through the power supply line 10 and the ground line 12. This circuit is a circuit to which the operating voltage is not applied when neither the first fuse 203 nor the second fuse 204 are melted. This circuit is the light-emitting diode of the photointerrupter 505 described above. The other signal line 13 is a line that conveys the SNS2 signal, which indicates an operation result of the circuit. The MCUs 301 and 401 detect when neither the first fuse 203 nor the second fuse 204 are melted in accordance with the SNS2 signal conveyed by the other signal line 13.

As described using FIG. 4, the embodiments provide the jig tool 400. The jig tool 400 supplies the melting current through the power supply line 10 and the signal line 11 in the case where the first fuse 203 is to be melted. Meanwhile, the jig tool 400 supplies the melting current through the signal line 11 and the ground line 12 in the case where the second fuse 204 is to be melted. The information is written by the person in charge of assembly (the operator) operating the jig tool 400, and thus the operator is freed from the complexity of manually setting small dip switches.

The melting circuit 420 may include the constant current source 414 and the protective resistor 413 that is connected in parallel to the constant current source 414 to ensure that overvoltage is not applied to the first fuse 203 or the second fuse 204. Providing the protective resistor 413 makes it possible to protect the first fuse 203 or the second fuse 204.

As described using FIG. 4, the first relay 410 is provided between a first terminal of the constant current source 414, and the power supply line 10 and ground line 12. The second relay 411 is provided between a second terminal of the constant current source 414 and the signal line 11. The third relay 412 is provided between the first terminal of the constant current source 414 and the ground line 12. The MCU 401 functions as a control circuit that controls the first relay 410, the second relay 411, and the third relay 412 in accordance with the information stored in the storage device. As described with reference to S4, the MCU 401 may function as a verification unit that verifies whether or not the correct information is held in the storage device. This makes it possible to easily verify whether or not the correct information has been stored.

The foregoing has described an example in which information is stored using two fuses. Here, thin-film fuses that can be mounted on a substrate with ease and that are inexpensive may be employed as the fuses. A fuse is a circuit element whose resistance value changes greatly from before the fuse is melted to after the fuse is melted. A fuse is furthermore a circuit element that is broken when a rated current flows therethrough and whose resistance value therefore changes permanently or irreversibly. Accordingly, any circuit element whose resistance value changes permanently or irreversibly is equivalent to a fuse and may therefore be employed instead of a fuse.

As illustrated in FIGS. 7, 8, and so on, the first fuse and the second fuse are connected in series. A sensor is connected in parallel to both the first fuse and the second fuse. The light emitting element and the resistance elements are also connected in series. Here, a circuit constituted by the first fuse and the second fuse is connected in parallel to a circuit constituted by the light emitting element and the resistance elements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-073215, filed Mar. 31, 2015 which is hereby incorporated by reference herein in its entirety.

What is claimed is:

1. A fixing apparatus for fixing an image onto a recording material, the apparatus comprising:

a fixing member configured to come into contact with the recording material onto which the image is formed and which fixes the image on the recording material;

a first fuse;

a second fuse connected in series to the first fuse;

a power supply line connected to one end of the first fuse;

a first signal line connected to a connection point between another end of the first fuse and one end of the second fuse; and a ground line connected to another end of the second fuse, wherein information regarding characteristics of the fixing member is held in accordance with melt states of the first and second fuses.

2. The fixing apparatus according to claim 1, wherein the information regarding characteristics of the fixing member includes first information, second information, and third information, and wherein the first information indicating characteristics of the fixing member is held when the first fuse is melted but the second fuse is not melted, the second information indicating characteristics of the fixing member is held when the first fuse is not melted but the second fuse is melted, and the third information indicating characteristics of the fixing member is held when both the first fuse and the second fuse are melted.

3. The fixing apparatus according to claim 1, wherein at least one of the first fuse and the second fuse is melted at the time of shipment from the factory.

4. The fixing apparatus according to claim 1, further comprising:

a connector including a terminal connected to the power supply line, a terminal connected to the first signal line, and a terminal connected to the ground line.

5. The fixing apparatus according to claim 1, further comprising:

a circuit element that is different from the first fuse and the second fuse, wherein a power supply voltage is applied to both the first fuse and the circuit element through the power supply line.

6. The fixing apparatus according to claim 2, wherein the first information indicating the characteristics of the fixing member is information regarding a glossiness of the fixing apparatus, and the second information indicating the characteristics of the fixing member is information regarding a fixing temperature of the fixing apparatus.

7. The fixing apparatus according to claim 1, further comprising:

a control unit including a first resistor connected in parallel to the first fuse by the power supply line and the first signal line, a second resistor connected in parallel to the second fuse by the first signal line and the ground line, and a determination circuit that is connected to the first signal line and is configured to determine the information held by the first fuse and the second fuse in accordance with a voltage at the first signal line.

8. The fixing apparatus according to claim 7, wherein the first resistor and the second resistor are a pull-up resistor and a pull-down resistor, respectively, for establishing the logic of the first signal line.

9. The fixing apparatus according to claim 8, further comprising:

a noise filter connected between the first signal line and an input of the determination circuit.

10. The fixing apparatus according to claim 7, further comprising:

a shorting protection unit configured to protect the power supply line and the ground line from shorting when neither the first fuse nor the second fuse is melted.

11. The fixing apparatus according to claim 10, wherein the shorting protection unit is a resistor inserted in the power supply line.

12. The fixing apparatus according to claim 7, further comprising:

a detecting unit configured to verify that neither the first fuse nor the second fuse is melted.

13. The fixing apparatus according to claim 12, wherein the fixing apparatus further comprises:

a second signal line that is different from the first signal line; and a circuit to which an operating voltage is supplied through the power supply line and the ground line, and to which the operating voltage is not applied when neither the first fuse nor the second fuse is melted;

wherein the second signal line is a line that conveys a signal indicating an operation result of the circuit; and wherein the detecting unit of the control device detects that neither the first fuse nor the second fuse is melted in accordance with the signal conveyed by the second signal line.

14. The fixing apparatus according to claim 1, further comprising:

a sensor configured to detect the recording material, wherein the first fuse and the second fuse are connected in series, and the sensor is connected in parallel to both the first fuse and the second fuse.

15. The fixing apparatus according to claim 14, wherein the sensor includes a light emitting element and a light receiving element;

wherein the fixing apparatus includes a resistance element connected in series to the light emitting element, and wherein a circuit constituted by the first fuse and the second fuse connected in series and a circuit constituted by the light emitting element and the resistance element connected in series are connected in parallel.

16. An image forming apparatus comprising:

an image forming unit configured to form a toner image on a recording material;

a fixing apparatus configured to fix the toner image formed by the image forming unit on the recording material;

wherein the fixing apparatus includes a fixing member configured to come into contact with the recording material onto which the image is formed and which fixes the image on the recording material; and a storage device configured to hold information regarding characteristics of the fixing member, wherein the storage device includes:

a first fuse;

a second fuse connected in series to the first fuse;

a power supply line connected to one end of the first fuse;

a signal line connected to a connection point between another end of the first fuse and one end of the second fuse; and a ground line connected to another end of the second fuse, and wherein the storage device holds information regarding characteristics of the fixing member in accordance with whether or not the first fuse is melted and whether or not the second fuse is melted.

17. The image forming apparatus according to claim 16, wherein the information regarding characteristics of the fixing member includes first information, second information, and third information, wherein the first information indicating characteristics of the fixing member is held when the first fuse is melted but the second fuse is not melted, the second information indicating characteristics of the fixing member is held when the first fuse is not melted but the second fuse is melted, and the third information indicating characteristics of the fixing member is held when both the first fuse and the second fuse are melted.

18. The image forming apparatus according to claim 17, wherein the first information indicating the characteristics of the fixing member is information regarding a glossiness of the fixing apparatus, and the second information indicating the characteristics of the fixing member is information regarding a fixing temperature of the fixing apparatus.

19. The image forming apparatus according to claim 16, further comprising:

a sensor configured to detect the recording material, wherein the first fuse and the second fuse, which are connected in series, and the sensor are connected in parallel.

20. The image forming apparatus according to claim 19, wherein the sensor includes a light emitting element and a light receiving element;

wherein the image forming apparatus includes a resistance element connected in series to the light emitting element; and wherein a circuit constituted by the first fuse and the second fuse connected in series and a circuit constituted by the light emitting element and the resistance element connected in series are connected in parallel.

* * * * *